US006113489A

United States Patent [19]

Nishi et al.

[11] Patent Number: 6,113,489

[45] Date of Patent: Sep. 5, 2000

[54] INGOT SLICING METHOD, AN INGOT MANUFACTURING METHOD AND A SLICED INGOT GRINDING APPARATUS

[75] Inventors: Kenichiro Nishi; Tetsuo Okuyama, both of Kanagawa; Mitsuru Nukui, Toyama; Kazuo Nakajima, Toyama; Shirou Murai, Toyama; Toyotaka Wada, Toyama; Tomio Nakagawa, Toyama, all of Japan

[73] Assignee: Nippei Toyama Corporation, Tokyo, Japan

[21] Appl. No.: 09/281,966

[22] Filed: Mar. 31, 1999

[30] Foreign Application Priority Data

Apr. 1, 1998 [JP] Japan ..... 10-088864

[51] Int. Cl.[7] ..... B24B 2/19

[52] U.S. Cl. ..... 457/262; 457/261; 457/286; 125/13.01

[58] Field of Search ..... 457/261, 262, 457/287, 288, 228, 286; 125/16.01, 16.02, 13.01

[56] References Cited

U.S. PATENT DOCUMENTS

| | | | |
|---|---|---|---|
| 4,227,348 | 10/1980 | Demers | 125/13.01 |
| 4,593,495 | 6/1986 | Kawakami et al. | 451/286 |
| 5,009,614 | 4/1991 | Arai et al. | 451/262 |
| 5,121,572 | 6/1992 | Hilscher | 451/262 |
| 5,934,983 | 8/1999 | Wada et al. | 451/262 |
| 5,967,882 | 10/1999 | Duescher | 451/262 |

*Primary Examiner*—David A. Scherbel
*Assistant Examiner*—George Nguyen
*Attorney, Agent, or Firm*—Sughrue, Mion, Zinn, Macpeak & Seas, PLLC

[57] ABSTRACT

A method of slicing an ingot wherein a pre-cut work 3 in which a holding member 2 extending over the entire length of a side surface of a cylindrical ingot 1 is bonded to the side surface of the ingot 1 is set on a slicing apparatus 4, and the pre-cut work 3 is split into a multiplicity of pieces over its longitudinal direction so as to obtain disk-shaped works 5 to be ground, characterized in that a retaining member 2 is used in which a retaining layer 7 which is directly bonded to the side surface of the ingot 1 by a first adhesive agent having an adhesive strength sufficient to receive a rotating force due to a grinding apparatus 6 in a subsequent grinding process, an intermediate layer 8 which is bonded to said retaining layer 7 in a superposed manner by a second adhesive agent whose adhesive strength deteriorates more than that of the first adhesive agent under a fixed condition, and a supporting layer 11 which is connected to said intermediate layer 8 and is connected to a supporting portion 10 of said slicing apparatus 4 are integrally superposed one on top another.

3 Claims, 5 Drawing Sheets

INGOT SLICING METHOD, AN INGOT MANUFACTURING METHOD AND A SLICED INGOT GRINDING APPARATUS

The present invention relates to a method of slicing an ingot for obtaining wafers by splitting a cylindrical ingot into a multiplicity of pieces over its longitudinal direction, an ingot manufacturing method for obtaining wafers by splitting a cylindrical ingot into a multiplicity of pieces over its longitudinal direction, and also a sliced ingot grinding apparatus.

Conventionally, a cylindrical ingot used in the field of semiconductors, for example, is finished into wafers by being consecutively subjected to a slicing process, a grinding process, and the like. A grinding apparatus is arranged such that, as shown in FIG. 7(*a*), after a work 5 to be ground (hereinafter referring pre-ground work 5) obtained from the ingot is fitted in a setting hole 26 in a carrier plate 23 so as to oppose a pair of grinding wheels 25 on both sides thereof. The pre-ground work 5 is ground by feeding the grinding wheels 25 while the carrier plate 23 is rotated.

The carrier plate 23 is fitted in an annular rotating frame 30 so as to cover its cavity portion 31. The annular rotating frame 30 is rotatably held by a plurality of support rollers 29 provided on an upper surface of a table 27 and each having a V-shaped supporting groove 28. Teeth portions 32 are formed on an outer peripheral surface of this rotating frame 30 and a drive gear 34 is mounted on a rotating shaft of a motor 33 secured on the table 27 in such a manner that the teeth portions 32 and the drive gear 34 of the motor 33 are engaged with each other. As the motor 33 is driven, the rotating frame 30 is rotated, to thereby rotate the carrier plate 23 set on its lower surface. The carrier plate 23 is formed of a plate-like member thinner than the thickness of the pre-ground work 5, and is mounted in a state that it is tensioned in the horizontal and its radial directions in such a manner that it is not deformed and deflected by its own weight. The setting hole 26 for fitting the pre-ground work 5 therein is formed in a central portion of the carrier plate 23. The grinding wheels 25 are rotated, and also raised or lowered in a vertical direction at positions above and below the carrier plate 23 while the same is offset in the horizontal direction from the center of the pre-ground work 5.

In order to rotate the pre-ground work, it is necessary to transmit the rotation of the carrier plate to the pre-ground work. Conventionally, utilized as a retaining portion for transmitting the rotating force is a notch 5*a* formed by cutting out a portion of a peripheral edge of the pre-ground work in a wedge shape (as shown in FIG. 7(*b*) or an orientation flat formed by rectilinearly cutting out a portion of a peripheral edge of the pre-ground work, and simultaneously utilized is the aforementioned setting hole which is set in a shape conforming to the outer shape of the pre-ground work.

However, semiconductors are expensive material, and if the pre-ground work is provided with the notch or the orientation flat, parts are taken by avoiding the notch or the orientation flat, so that there has been a problem that wasted portions of the material are produced in a large quantity. In addition, in conjunction with the enlargement of the wafer diameter being made on a day-to-day basis for increasing the number of chips obtained from one wafer, the wastes due to the formation of the notches and the orientation flats tend to increase further.

Accordingly, marking using a laser, for instance, has recently come to be adopted as another means for providing a rough criterion for the crystal orientation, and as the means for transmitting the rotating force of the aforementioned carrier plate, a means which is not based on the aforementioned notch or orientation flat is desired.

SUMMARY OF THE INVENTION

The present inventors conceived an invention in view of the above-described circumstances, and it is an object of the present invention to solve the above-mentioned conventional problem. In addition, it is also an object of the present invention to provide a method of slicing and manufacturing an ingot whereby a retaining portion in the pre-ground work for transmitting the rotating force can be formed without undergoing a complicated process after undergoing the slicing process and without involving a cutout at the peripheral edge of the pre-ground work, and also to provide a sliced ingot grinding apparatus.

The above-mentioned object can be achieved by an ingot slicing method in which a peripheral surface of a cylindrical ingot member is held through an adhesive by a holding member extending over the entire length of the peripheral surface of the cylindrical ingot member, and the ingot member held by the holding member is split into a multiplicity of pieces over its longitudinal direction so as to obtain disk-shaped works to be ground, the ingot slicing method, according to the present invention, comprising the steps of:

preparing the holding member which comprises bonding a retaining layer, an intermediate layer and a supporting layer;

bonding the retaining layer to the ingot member by a first adhesive agent having an adhesive strength sufficient to receive a rotating force due to a grinding apparatus in a subsequent grinding process;

bonding the intermediate layer to the retaining layer in a superposed manner by a second adhesive agent having adhesive strength which deteriorates more than that of the first adhesive agent under a predetermined condition, connecting the supporting layer to the intermediate layer in a superposed manner;

coupling the supporting layer to a supporting portion of the slicing apparatus; and slicing the ingot member together with a part of the holding member while keeping an integrally superposed posture formed by superposing the retaining layer, the intermediate layer and the supporting layer.

In addition, the above-mentioned object can also be achieved by an ingot manufacturing method in which a peripheral surface of a cylindrical ingot member is held through an adhesive by a holding member extending over the entire length of the peripheral surface of the cylindrical ingot member, and the ingot member held by the holding member is split into a multiplicity of pieces over its longitudinal direction so as to obtain disk-shaped works to be ground, the ingot manufacturing method, according to the present invention, comprising the steps of:

preparing the holding member which comprises bonding a retaining layer, an intermediate layer and a supporting layer;

bonding the retaining layer to the ingot member by a first adhesive agent having an adhesive strength sufficient to receive a rotating force due to a grinding apparatus in a subsequent grinding process;

bonding the intermediate layer to the retaining layer in a superposed manner by a second adhesive agent having adhesive strength which deteriorates more than that of the first adhesive agent under a predetermined condition, connecting the supporting layer to the intermediate layer in a superposed manner;

coupling the supporting layer to a supporting portion of the slicing apparatus;

slicing the ingot member together with a part of the holding member while keeping an integrally superposed posture formed by superposing the retaining layer, the intermediate layer and the supporting layer;

subjecting the predetermined condition to the ingot member thus sliced so as to separate the intermediate layer and a combined sliced piece formed by the retaining layer and the ingot member;

setting the combined sliced piece into a setting hole of a grinding apparatus in which the setting hole has a shape in conformity with an outer shape of the combined sliced piece; and grinding the combined sliced piece thus set into the setting hole.

In the above-mentioned ingot slicing or manufacturing method, it is preferable that the predetermined condition is a heating condition in such a manner that the second adhesive agent has adhesive strength deteriorates at temperature lower than the adhesive strength of the first adhesive agent.

In the above-mentioned ingot slicing or manufacturing method, it is preferable that the predetermined condition is a dissolution condition in such a manner that the second adhesive agent is dissolved by a solvent which does not dissolve the first adhesive agent.

Further, the above-mentioned object can be achieved by a sliced ingot grinding apparatus comprising:

a pair of grinding wheels; and a carrier plate interposed between the grinding wheels and having a sliced work setting hole for preventing a sliced work set into the setting hole from rotating relative to the carrier plate, in which the setting hole has a shape in conformity with an outer shape of sliced work which comprises an round-shape ingot member and a retaining member secured on the peripheral surface of the round-shape ingot member through an adhesive agent.

In the above-mentioned sliced ingot grinding apparatus, it is preferable that the retaining layer is made of a material containing an abrasive grain capable of dressing the grinding wheels.

Moreover, the method of slicing an ingot in accordance with the present invention devised to overcome the above-described problems is characterized by being a method of slicing an ingot wherein a work (3) to be cut in which a holding member (2) extending over the entire length of a side surface of a cylindrical ingot (1) is bonded to the side surface of the ingot (1) is set on a slicing apparatus (4), and the work (3) to be cut is split into a multiplicity of pieces over its longitudinal direction so as to obtain disk-shaped works (5) to be ground, characterized in that a retaining member (2) is used in which a retaining layer (7) which is directly bonded to the side surface of the ingot (1) by a first adhesive agent having an adhesive strength sufficient to receive a rotating force due to a grinding apparatus (6) in a subsequent grinding process, an intermediate layer (8) which is bonded to said retaining layer (7) in a superposed manner by a second adhesive agent whose adhesive strength deteriorates more than that of the first adhesive agent under a fixed condition, and a supporting layer (11) which is connected to said intermediate layer (8) and is connected to a supporting portion (10) of said slicing apparatus (4) are integrally superposed one on top another. It should be noted that the respective adhesive agents need to be provided with appropriate adhesive strength corresponding to their respective roles (the weight to be supported, an external force which is applied, and so on) in a general operating environment excluding the aforementioned fixed condition.

The mode of the slicing apparatus is not particularly limited, and it is sufficient if the slicing apparatus has the supporting portion which can be connected to the supporting layer. As for the aforementioned grinding apparatus as well, it is sufficient if it is a grinding apparatus which is capable of transmitting a rotating force to the works to be ground via the retaining layer provided on the works to be ground (in the case there a mode is adopted in which the works to be ground are rotated in the grinding operation), or if it is a grinding apparatus which is capable of transmitting a braking force thereto (in the case there a mode is adopted in which a grinding wheel is rotated in the grinding operation).

As the fixed condition under which "adhesive strength deteriorates more than that of the first adhesive agent under a predetermined condition," it is possible to cite a physical property with respect to heat or a solvent. As specific examples of the combination of the first adhesive agent and the second adhesive agent, it is possible to cite, among others, a combination of the first adhesive agent which is a thermosetting adhesive agent (epoxy-based adhesive agent or the like) and the second adhesive agent which melts by heat (such as wax), and a combination of the first adhesive agent which is an adhesive agent in which a resin or rubber is dissolved in an organic solvent and the second adhesive agent which is a water-soluble adhesive agent. Under whatever fixed conditions, the greater the difference in the degree of deterioration between the first adhesive agent and the second adhesive agent, the more desirable.

It should be noted that the retaining layer, the intermediate layer, and the supporting layer need to be provided with strength necessary for their respective functions, and may be formed of basic material such as carbon, resin moldings, a mixture of resin, glass, and a ceramic, and a composite material of a resin and (resin, ceramic, or glass) fibers. As for the supporting layer, since it need not be cut together with the ingot during slicing, a hard metal may be used. In addition, the connecting means for connecting the intermediate layer and the supporting layer is sufficient if it has connecting strength capable of supporting the weight of the intermediate layer, the retaining layer, and the ingot during slicing, and the connecting means may be connected in any form including connection by an adhesive agent. However, to reuse the supporting layer which has been used once, it is desirable to provide in advance a connecting means whereby connecting portions of the two members are fitted and fixed to each other by bolts and the like so as to be formed as a single unit. As for the connecting means for connecting the supporting layer to the supporting portion of the slicing apparatus, it is sufficient if the connecting means is made to conform to the supporting form of the slicing apparatus.

DETAILED DESCRIPTION OF THE PREFERRED EMBODIMENTS

Figure 1:
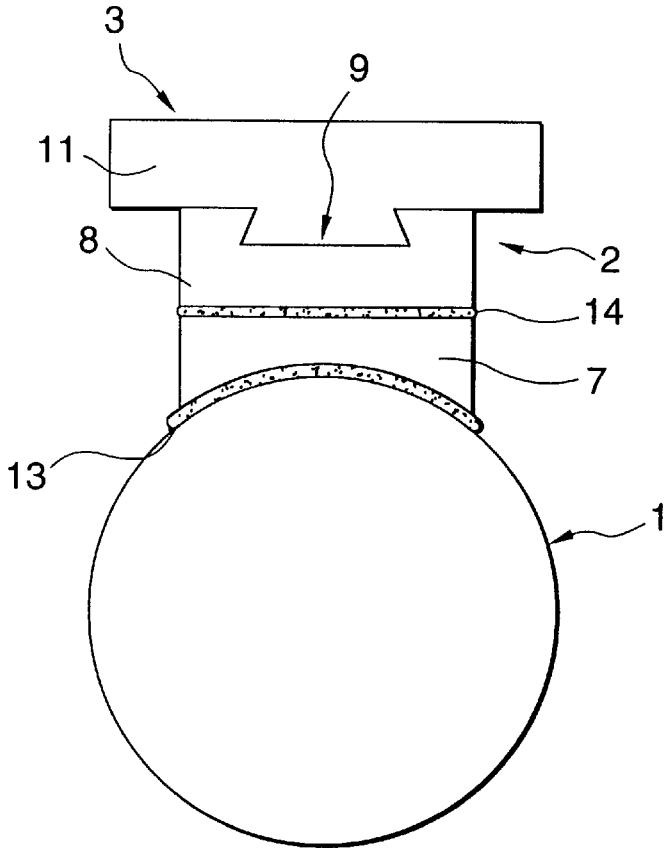
FIG. 1 is a front view illustrating one example of a work to be cut which is used in the method of slicing an ingot in accordance with the present invention.

Hereafter, a description will be given of a method of slicing an ingot in accordance with the present invention, and also a grinding apparatus for sliced work with reference to the drawings.

This slicing method is a method of slicing an ingot whereby a work 3 to be cut (hereinafter referring a pre-cut work 3) which is formed by bonding a holding member 2 to a peripheral surface of a cylindrical ingot 1 over its entire length in an axial direction thereof is set on a slicing apparatus 4, and the pre-cut work 3 is split into a multiplicity of pieces over its longitudinal direction so as to obtain disk-shaped works 5 to be ground (that is, disk-shaped pre-ground works 5).

Figure 2:
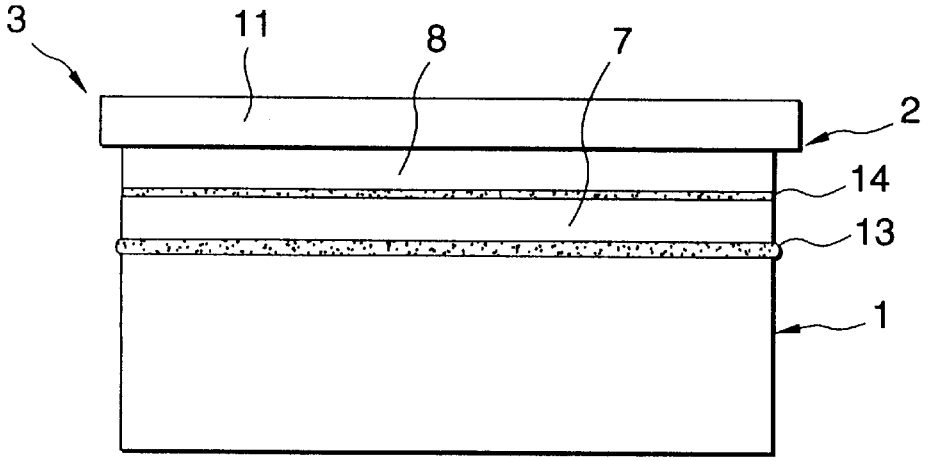
FIG. 2 is a side view illustrating the example of the work to be cut which is used in the method of slicing an ingot in accordance with the present invention.

In the method of slicing an ingot in accordance with the present invention, as shown in FIGS. 1 and 2, the holding member 2 has a three-layered structure. The three-layered structure is composed of a retaining layer 7 made of carbon, an intermediate layer 8 made of carbon, and a supporting layer 11 made of a metal which are superposed one on top of another as shown in FIGS. 1 and 2. The retaining layer 7 is directly bonded to the side surface (in other words, the peripheral surface) of the ingot 1 by an epoxy-based adhesive agent 13 as a first adhesive agent. The epoxy-based adhesive agent 13 has an adhesive strength sufficient to support the weight of the ingot 1 and to receive the rotating force due to a grinding apparatus 6 in a subsequent grinding process. Meanwhile, the intermediate layer 8 is bonded to the retaining layer 7 in a superposed manner by wax for bonding 14 (as a second adhesive agent; ADFIX (product name which is manufacted by NIKKA SEIKO KABUSHIKI KAISHA) or an equivalent) which can support the weight of the retaining layer 7 and the ingot 1 and whose bonding function disappears by solating (in other words, by forming a sol) at a temperature sufficiently lower than the temperature at which the adhesive strength of the epoxy-based adhesive agent 13 deteriorates. The supporting layer 11 is superposed on the intermediate layer 8 via a fitting portion, as one example of connecting/coupling mechanism, capable of supporting the weight of the intermediate layer 8, the retaining layer 7, and the ingot 1, and is connected to a supporting portion 10 of the slicing apparatus 4.

The wax 14 for bonding (hereinafter referring a bonding wax 14) has a melting point of 80° C. and gelates (in other words, forming a gel) (that is, undergoes initial hardening) if the temperature exceeds 150° C. When the bonding wax 14 is used for bonding, the bonding wax 14 is temporarily allowed to solate at an appropriate temperature (100–140° C. or thereabouts), is applied to the an adhesive surface, and is allowed to cool naturally.

The epoxy-based adhesive agent 13 may be used by a method of use corresponding to its type.

Figure 3:
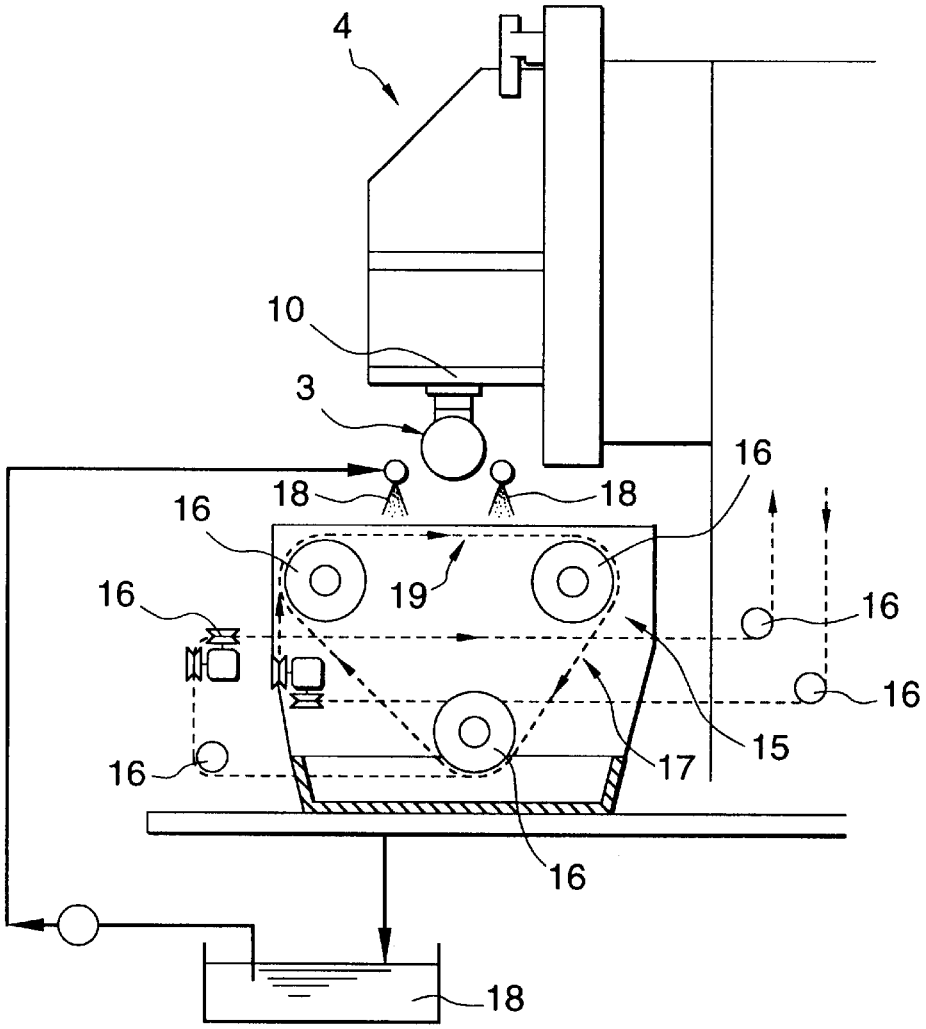
FIG. 3 is a schematic diagram of a slicing apparatus used in the method of slicing an ingot in accordance with the present invention.

As shown in FIG. 3, the aforementioned slicing apparatus 4 has a wire saw 15 which is arranged such that a wire 17 wound around a plurality of working rollers 16 is fed in one direction or reciprocated so as to slice the pre-cut work 3. The work 3 is sliced by a lapping operation of abrasive grains contained in the slurry which are supplied on the respective portions of the wire 17 or by a lapping operation of abrasive grains secured on the wire 17 itself, while the work 3 is horizontally set on the slicing apparatus 4, pressed onto the wire 17 and cut perpendicularly to its longitudinal direction. The arrangement provided at that time is such that a plurality of cutting portions 19 on which the respective portions of the wire 17 travels horizontally are arranged at a predetermined pitches in the longitudinal direction of the pre-cut work 3, thereby making it possible to slice the pre-cut work 3 into the multiplicity of works 5 to be ground by a single cutting operation.

Figure 4:
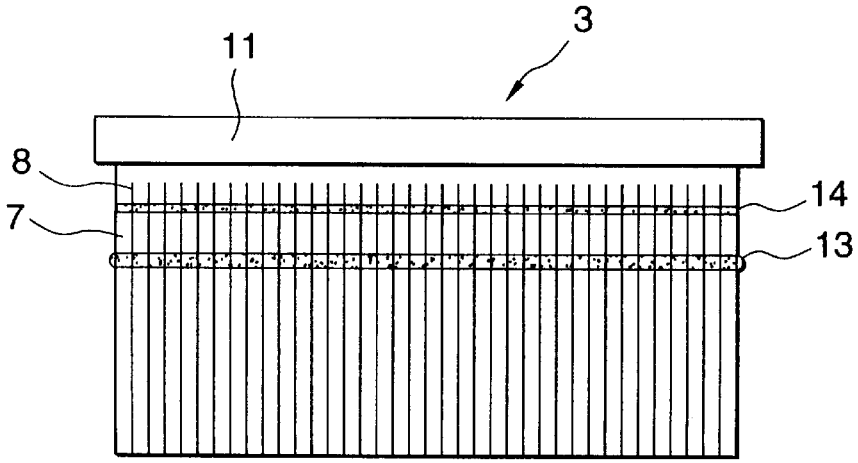
FIG. 4 is a side view illustrating an example of the work to be cut for which a slicing process has been completed by the method of slicing an ingot in accordance with the present invention.
Figure 5:
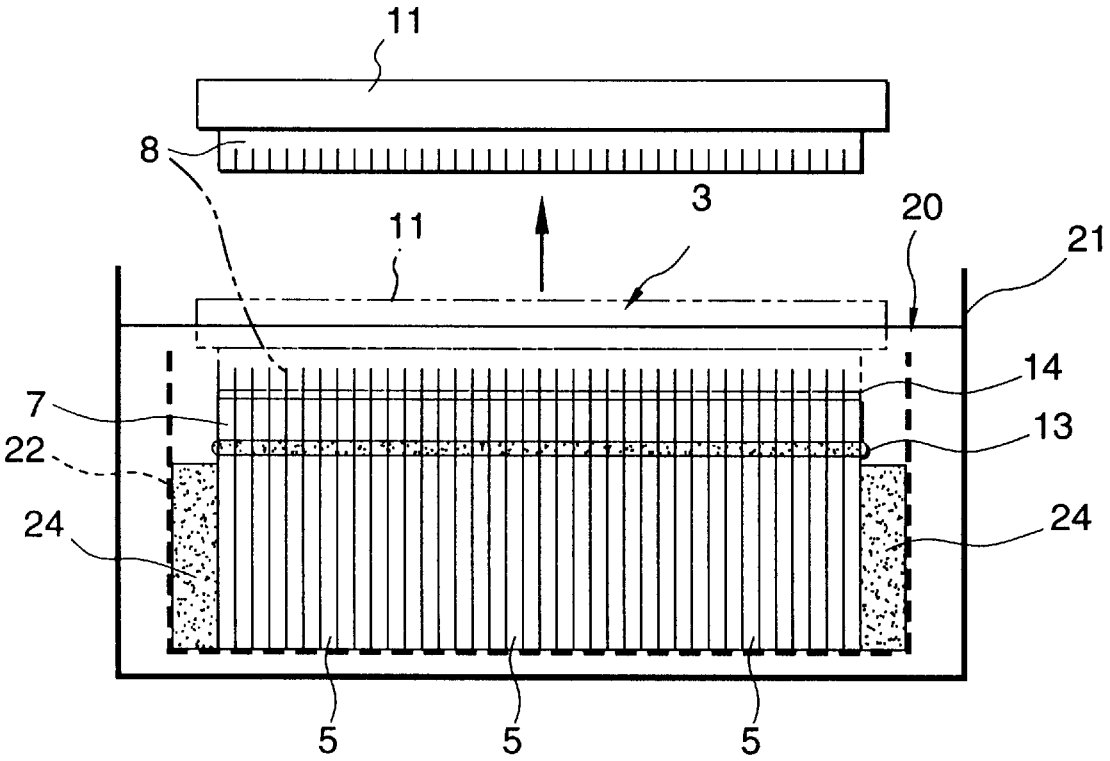
FIG. 5 is a side view illustrating an example of a state in which works to be ground are obtained from the work to be cut for which the slicing process has been completed by the method of slicing an ingot in accordance with the present invention.

As shown in FIG. 4, since the works 5 to be ground, for which the slicing operation by the cutting portions 19 has been completed, have been cut in from the lower portion of the works 5 to be ground in a range including the whole portions of the ingot 1 and the holding member 2 and a lower portion of the intermediate layer 8, the works 5 to be ground remain unseparated by the supporting layer 7 and the portion of the intermediate layer 8. As shown in FIG. 5, in the slicing apparatus 4, after all the slicing operation of the single pre-cut work 3 is finished, the sliced work is immersed in a receiving tank 21 in which hot water 20 at about 80° C. is stored. The bonding wax 14 solates (forms sol) by the heat of the hot water 20, and the adhesive strength between the retaining layer 7 and the intermediate layer 8 in the holding member 2 is lost, thereby making it possible to obtain individually separated works 5 to be ground which contains an round-shape sliced ingot and a sliced retaining layer 7. A receiving basket 22 capable of accommodating the entire pre-cut work 3 and provided with a cushioning material 24 for preventing damage to the multiplicity of superposed works 5 to be ground is submerged in advance in the hot water 20 in the receiving tank 21. As the receiving basket 22 is pulled upward, the individually separated works 5 to be ground can be collected at one time. Incidentally, in the case where the bonding wax 14 is used, if a predetermined release agent instead of the hot water 20 is stored in the receiving tank 21, the works 5 to be ground can be separated in a similar manner.

Note that, the sliced retaining layer 7, which is not released at a temperature of about 80° C., remains at edge portions of the works 5 in such a manner that the sliced retaining layer 7 can be effectively utilized in a subsequent grinding process.

Figure 6:
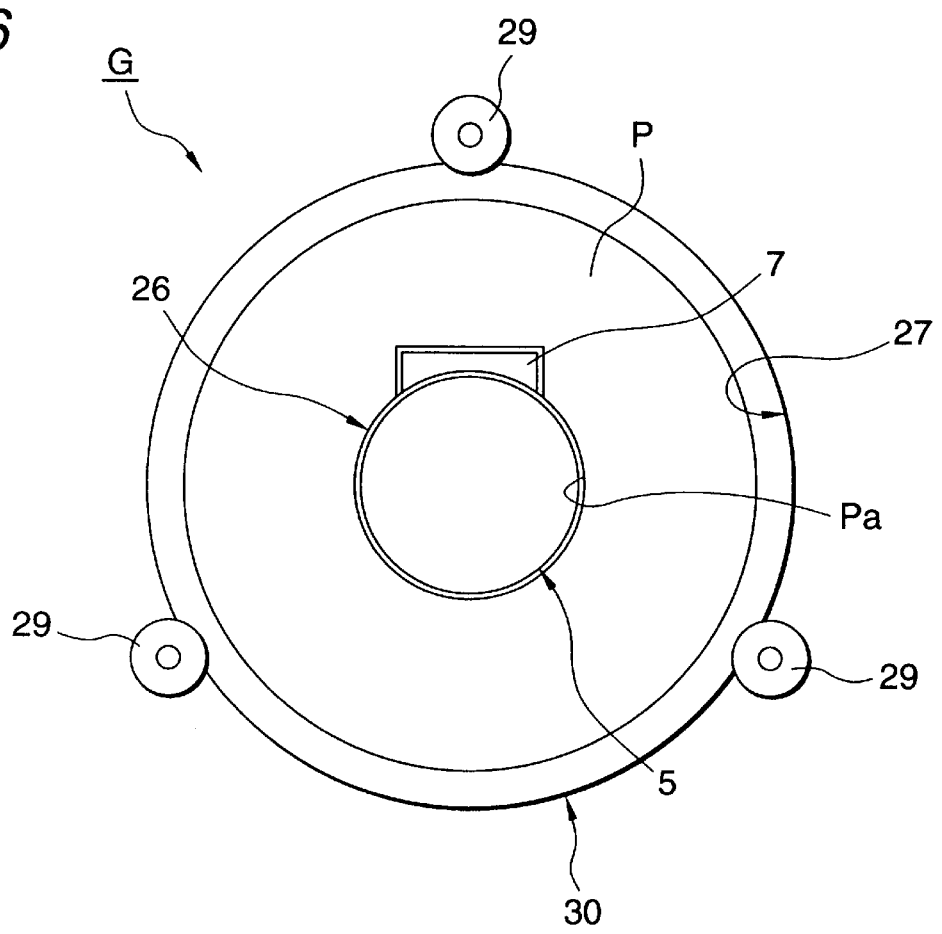
FIG. 6 is a plan view illustrating a state in which the works to be ground which have been obtained by the method of slicing an ingot in accordance with the present invention has been set on a grinding apparatus according to the other aspect of the present invention.
Figure 7A:
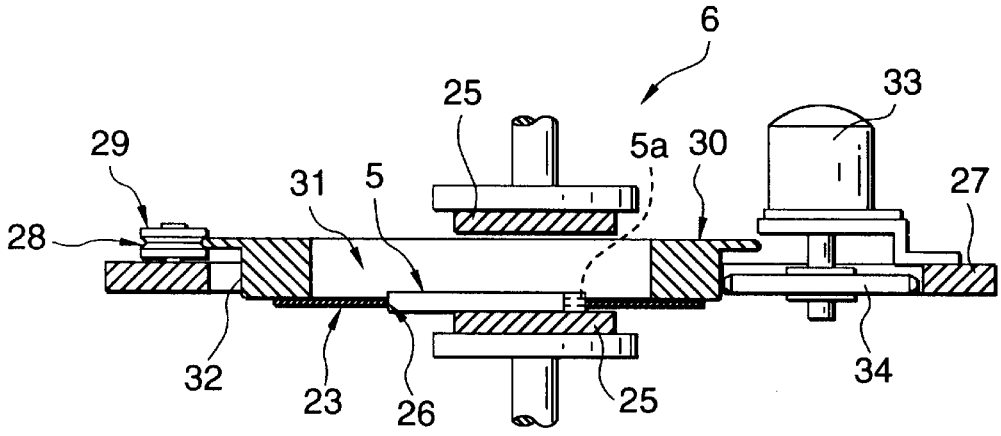
FIG. 7(*a*) is a cross-sectional view illustrating an example of the state in which the pre-ground work which has been set on the grinding apparatus, and FIG. 7(*b*) is a plane view illustrating the pre-ground work set on the same.
Figure 7B:
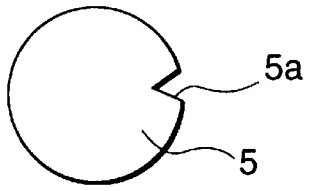

An example of a grinding apparatus G according to the present invention is structurally different from the conventional grinding apparatus shown in FIG. 7(*a*) only in a shape of the carrier plate 23. As clearly shown in FIG. 6. the carrier plate P according to the present invention is provided with a through-hole shaped setting hole Pa having a shape in conformity with the outer shape of the pre-ground work 5 consisting of the round-shaped sliced ingot and the sliced retaining layer 7.

As shown in FIG. 6, the setting hole Pa in the carrier plate P of the grinding apparatus G used in the subsequent grinding process is set in advance into a shape to which the works 5 to be ground are just fitted, the retaining layer 7 which constitutes the works 5 to be ground together with the ingot 1 serves as a claw when the ingot 1 having an outer periphery substantially similar to a truly circular shape is rotated or made stationary, and also serves as a rough criterion when the crystal orientation of the semiconductor of the ingot 1 is recognized. When the retaining layer 7 has become unnecessary after the completion of the grinding process, the retaining layer 7 can be easily removed from the works 5 to be ground by a solvent suitable for the relevant epoxy-based adhesive agent.

Figure 8:
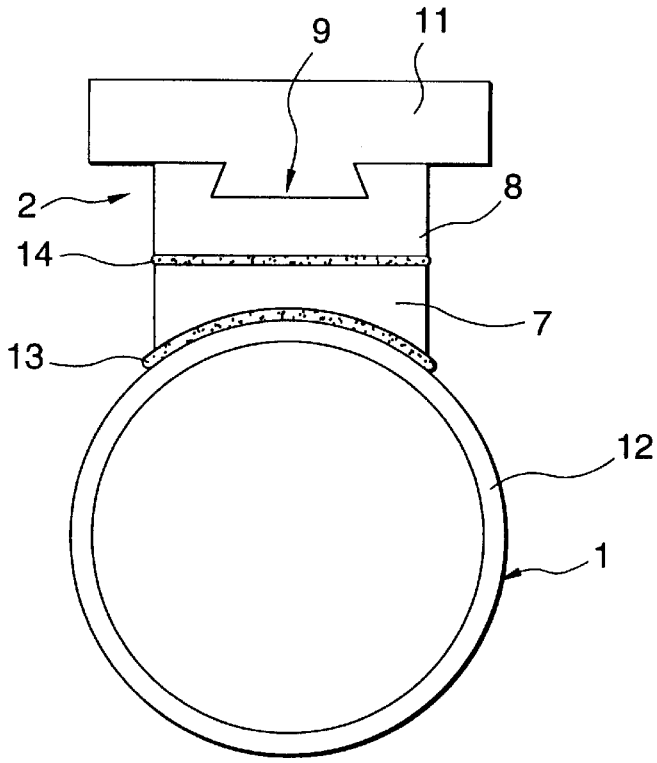
FIG. 8 is a front view illustrating a type of a work to be cut which is used in the method of slicing an ingot in accordance with the present invention.
Figure 9:
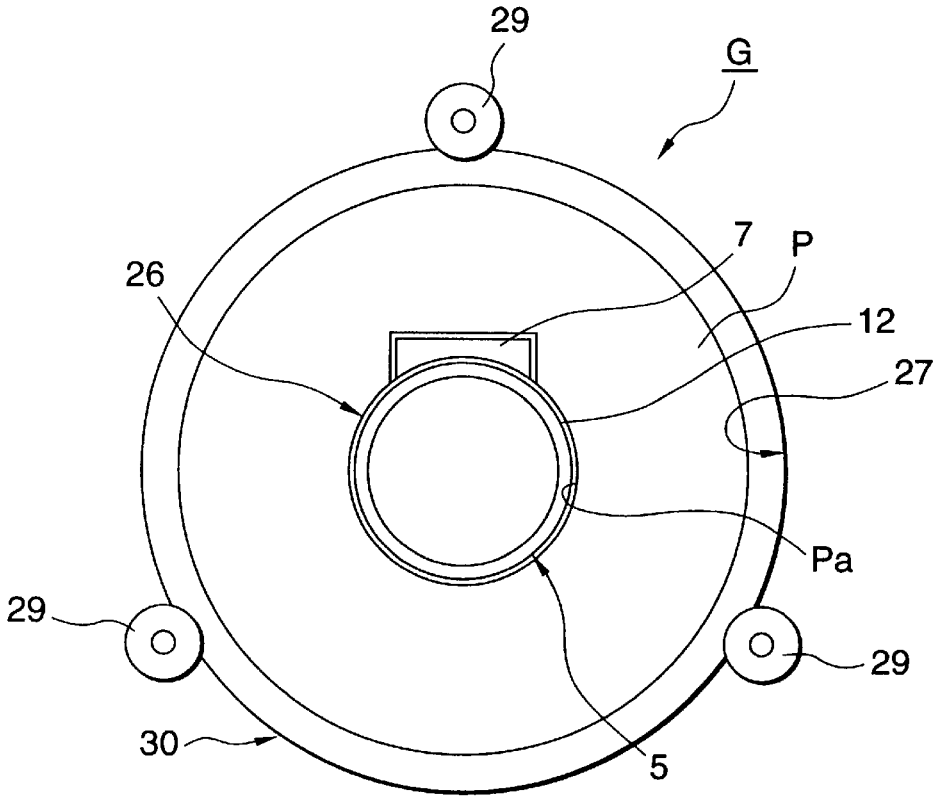
FIG. 9 is a cross-sectional view illustrating a type of the state in which works to be ground obtained by the method of slicing an ingot in accordance with the present invention has been set on the grinding apparatus according to the other aspect of the present invention.

FIGS. 8 and 9 show a case in which the ingot 1 with a protective layer 12 attached to the overall region of the side surface (in other words, the peripheral surface) of the pre-cut work 3 is used. The holding member 2 extending over the entire length of the side surface of the ingot 1 is bonded to the side surface of the ingot 1 in the same way as the one above-described example. That assembly is set on the slicing apparatus 4 as the pre-cut work 3, and the pre-cut work 3 is split into a multiplicity of pieces over its longitudinal direction so as to obtain the disk-shaped works 5 to be ground. The material constituting the protecting layer 12 is not limited to a particular kind insofar as it is capable of preventing damage to the works and also of forming a film whose adhesiveness to the side surface of the ingot 1 is excellent. However, it is desirable to use a material which is released simultaneously when the sliced retaining layer 7 which has undergone the grinding process to be described later is removed from the wafers, i.e., a material having the same base as that of the first adhesive agent. For example, if the epoxy-based adhesive agent is used as the first adhesive agent, an epoxy-based film is similarly formed as the protective layer 12, thereby making it possible to increase the adhesiveness to the epoxy-based adhesive agent for bonding the retaining layer 7 and making it possible to simultaneously remove the protective layer 12 by a solvent for the epoxy-based adhesive agent.

In addition, it is possible that the retaining layer is made of a material containing an abrasive grain capable of dressing the grinding wheel 25 of the grinding apparatus when the grinding process is conducted. Namely, the grinding process for the work and the dressing process for the grinding wheel are simultaneously conducted by the use of the retaining layer containing such an abrasive grain, so that an excellent grinding process can be continuously conducted and also the number of dressing operation for the grinding wheel can be reduced.

The present invention is based on Japanese Patent Application No. Hei. 10-88864, which is incorporated herein by reference.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

As described above, in the method of slicing an ingot and also the grinding apparatus in accordance with the present invention , since the retaining portion for the transmission of the rotating force, which also serves as a rough criteria for the crystal orientation in the works to be ground, can be formed without undergoing a complicated process after undergoing the slicing process, it is possible to simplify the process when the semiconductor chips are manufactured. Moreover, means is not adopted which cuts out peripheral edges of the works to be ground obtained by slicing work to be cut, so that it is possible to increase the area where the semiconductor chips can be formed. Accordingly, the number of chips which can be obtained from a single semiconductor wafer increases, making it possible to effectively utilize the precious material.

In addition, in the case where a protective layer is attached to the side surface of the ingot, since the works to be ground are fitted in the setting hole of the carrier plate with the protective layer interposed therebetween, the works to be ground themselves are not brought into direct contact with the setting hole during both in the transport process and in the subsequent grinding process. Accordingly, the grinding process can be effectively conducted without causing any damage to the works to be ground by an impact during grinding.

What is claimed is:

1. A sliced ingot grinding apparatus comprising:

a pair of grinding wheels; and a carrier plate interposed between said grinding wheels and having a sliced work setting hole for preventing a sliced work set into the setting hole from rotating relative to said carrier plate, in which said setting hole has a shape in conformity with an outer shape of sliced work which comprises a round-shape ingot member and a retaining member secured on the peripheral surface of the round-shape ingot member through an adhesive agent.

2. The sliced ingot grinding apparatus according to claim 1, in which said ingot member (1) comprises an ingot (1) and a protected member for covering the entire peripheral surface of said ingot (1).

3. The sliced ingot grinding apparatus according to claim 1, in which said retaining layer (7) is made of a material containing an abrasive grain capable of dressing said grinding wheels.

* * * * *